US011697481B2

(12) United States Patent
Meinel Cheesman

(10) Patent No.: US 11,697,481 B2
(45) Date of Patent: Jul. 11, 2023

(54) INDIVIDUAL DEVICE FOR AQUATIC PROPULSION

(71) Applicant: Kurt Franz Meinel Cheesman, Lima (PE)

(72) Inventor: Kurt Franz Meinel Cheesman, Lima (PE)

( * ) Notice: Subject to any disclaimer, the term of this patent is extended or adjusted under 35 U.S.C. 154(b) by 191 days.

(21) Appl. No.: 17/278,362

(22) PCT Filed: Feb. 6, 2019

(86) PCT No.: PCT/PE2019/000002

§ 371 (c)(1),
(2) Date: Mar. 22, 2021

(87) PCT Pub. No.: WO2020/071929

PCT Pub. Date: Apr. 9, 2020

(65) Prior Publication Data

US 2021/0347456 A1 Nov. 11, 2021

(30) Foreign Application Priority Data

Oct. 5, 2018 (PE) ..... 001960-2018/DIN

(51) Int. Cl.
*B63H 1/36* (2006.01)
*A63B 35/02* (2006.01)
*B63H 16/18* (2006.01)

(52) U.S. Cl.
CPC ..... *B63H 1/36* (2013.01); *A63B 35/02* (2013.01); *B63H 16/18* (2013.01)

(58) Field of Classification Search
CPC ..... A63B 35/02; A63B 35/10; B63H 1/36; B63H 16/18
USPC ..... 441/55, 60, 61, 64
See application file for complete search history.

(56) References Cited

U.S. PATENT DOCUMENTS 1,530,560 A * 3/1925 Heminger ..... A63B 35/02 441/55
3,426,722 A * 2/1969 Nicholas ..... A63B 35/02 441/55
3,440,994 A * 4/1969 McGowan ..... A63B 35/02 440/32
3,529,565 A 9/1970 Iglesias
4,193,371 A * 3/1980 Baulard-Caugan .... A63B 35/02 440/15
4,869,696 A * 9/1989 Ciccotelli ..... A63B 31/11 441/55

(Continued)

FOREIGN PATENT DOCUMENTS

CN 207153013 U 3/2018
DE 4031336 A1 4/1992

(Continued)

OTHER PUBLICATIONS

International Search Report dated May 21, 2019 for PCT/PE2019/000002 and English translation.

*Primary Examiner* — Daniel V Venne
(74) *Attorney, Agent, or Firm* — Lucas & Mercanti, LLP

(57) ABSTRACT

A device that propels a swimmer to move above or below the water surface allowing it to ascend, dive or turn on its axis is disclosed. It allows great capability of movement in water, due to its control fins. This allows it to be used as a sport, recreational, water use item, such as diving or to equip lifeguards or water rescue teams that need to move at higher speeds.

5 Claims, 3 Drawing Sheets

(56) References Cited

U.S. PATENT DOCUMENTS

| | | | | |
|---|---|---|---|---|
| 6,033,276 | A | 3/2000 | Han | |
| 6,524,145 | B1 * | 2/2003 | Arzate | A63B 35/02 440/26 |
| 6,561,862 | B1 * | 5/2003 | Moore | A63B 35/02 440/32 |
| 2018/0001145 | A1 | 1/2018 | Martino | |

FOREIGN PATENT DOCUMENTS

| | | | |
|---|---|---|---|
| ES | 1049165 | U | 11/2001 |
| RU | 2083251 | C1 | 7/1997 |

* cited by examiner

INDIVIDUAL DEVICE FOR AQUATIC PROPULSION

CROSS REFERENCE TO RELATED APPLICATION

This Application is a 371 of PCT/PE2019/000002 filed on Feb. 6, 2019, which, in turn, claimed the priority of Peruvian Patent Application No. 001960-2018/DIN filed on Oct. 5, 2018, both applications are incorporated herein by reference.

TECHNICAL SECTOR

The invention is developed in the technical sector related to individual devices for the generation of propulsion on the surface or under water. It can be used for sports purposes of water competitions, diving, or as a means of propulsion in the water for life-saving or rescue equipment that allows greater speed in the water.

STATE OF THE ART

Nowadays there are known fins that are used on the feet and move vertically, either alternating the feet up and down or with both feet at the same time.

Devices that move a vertical fin, horizontally, in an alternate movement of the feet extending and retracting the legs are also known in the Vertical Tail Fin Utility Model with publication number ES1049165 where a fin is shown attached to a pair of booties, which because of their semi-circular movement would not produce the necessary momentum in the water. In addition, it does not have a vertical stabilizing surface to counteract or cancel out the reaction force produced by the tail fin.

Neither is there a horizontal stabilizer, which serves to maintain the horizontality or to produce ascents and dives.

Likewise in this model of invention it is mentioned that these devices require additional flotation, since by the form of horizontal and not vertical fluttering, they tend to sink.

It is also proposed in the utility model with number CN207153013 which is a device that moves a horizontal fin moved by the knee joint, which does not get its strength from the longitudinal movement of the legs, but from the joints of these. In addition, it is not easy to attach to the body since it has a series of straps that holds it to the legs, 12 in total, which is not quick to install or disconnect.

Therefore it would be desirable to develop a device that moves a vertical fin horizontally and has the horizontal and vertical stability with alternate leg movement to take advantage of its extension force. It should also have directional controls moved with the hands to give direction to the movement.

DETAILED DESCRIPTION OF THE INVENTION

The present invention is a device which permits to use as a means of propulsion, a vertical tail fin with the use of the legs to reach high speeds above and under water and of great maneuverability.

By alternately extending and retracting the legs, the feet move pedals placed alongside the main body of the device. These pedals with support for the feet transmit their movement to the vertical tail fin by means of rods that are connected to a T-shaped structure, which is connected to the base of the tail fin. The T-shaped structure causes the force applied to the pedals to make a leverage or momentum effect, so that it moves the vertical tail fin with the force necessary to produce forward propulsion.

In the main body at the height of the hinge, there is a widening that acts as a vertical stabilizer to counteract the effect against the movement of the vertical fin. It also has on each side of the main body, a horizontal stabilizing fin to provide the device with the ability to maintain its horizontability and prevent it from sinking. This main body with a fin will be attached to the swimmer's body by a tube that at its end will be attached to a semi-arch, which serves to hold the swimmer's hip. At the sides of the semi-arch are variable horizontal control fins, which are moved by control levers with a handle, which serve to adjust the angle of attack of the fins individually, which allow the device to ascend, dive or turn on its axis.

DESCRIPTION OF THE FIGURES

To complement the description and with the aim of facilitating the understanding of the characteristics of the invention, a set of illustrative and non-limiting drawings are attached to this descriptive report.

Figure 1:
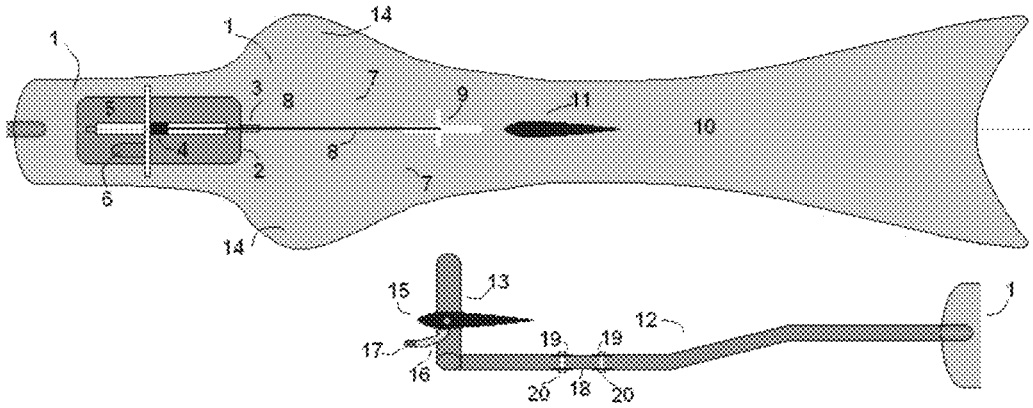
FIG. 1: Device profile view.
Figure 2:
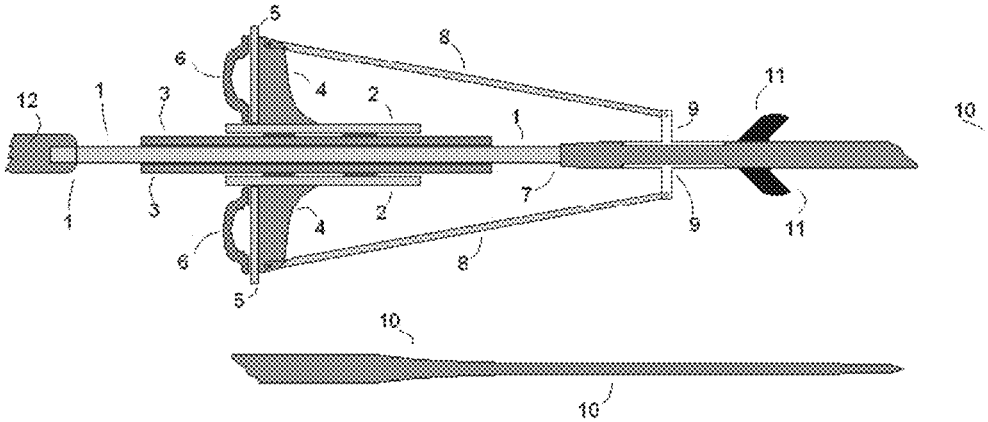
FIG. 2: Top view of the middle part of the device.
Figure 3:
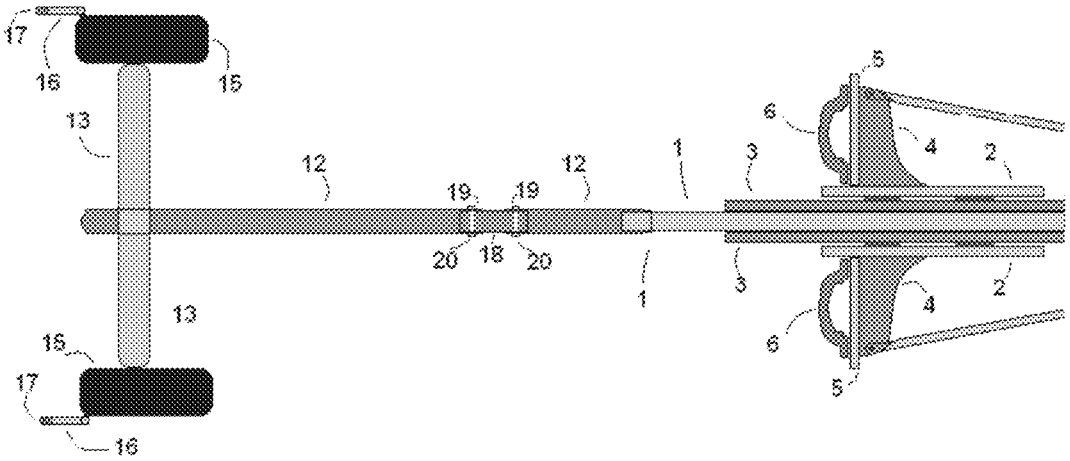
FIG. 3: Top view of the front of the device.
Figure 4:
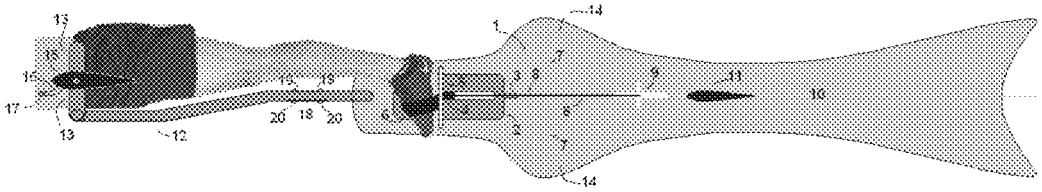
FIG. 4: Side view with the swimmer showing its use.
Figure 5:
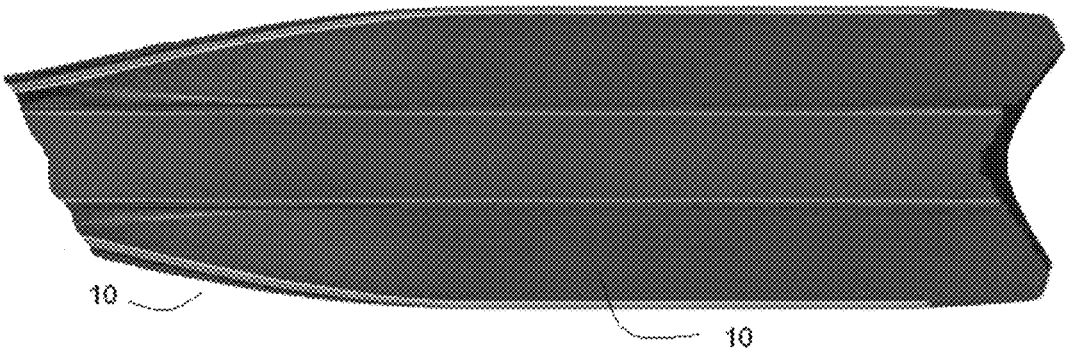
FIG. 5: Side view of the vertical tail fin.
Figure 6:
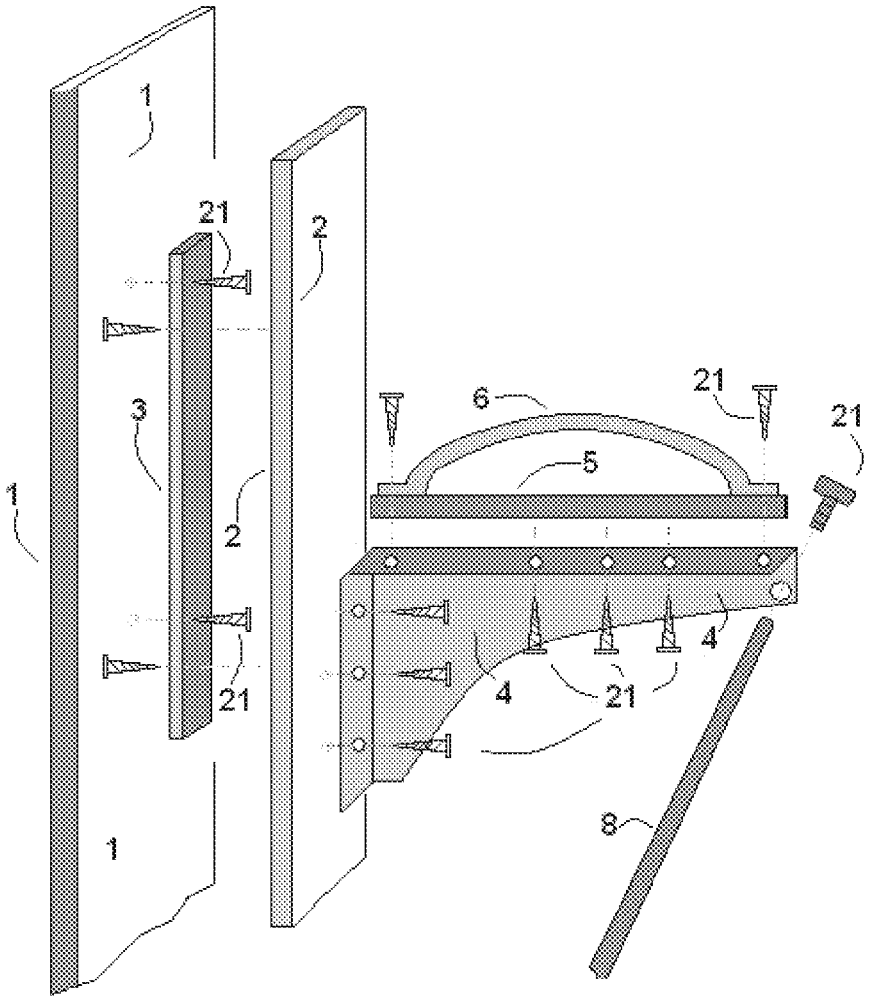
FIG. 6: View of the union of the pedals, rails, side plates and rods to the main body.

In these figures appear numerical references of the following elements that configure and/or allow the understanding of the invention:

1. Main body
2. Lateral plates
3. Rails.
4. Brackets.
5. Pedals.
6. Instep supports for the feet.
7. Hinge
8. Rods.
9. T-shaped support.
10. Vertical tail fin.
11. Horizontal stabilizing fin.
12. Bar that holds a semi-arch.
13. Semi-hoop.
14. Widening that acts as a vertical stabilizer
15. Variable horizontal control fin
16. Angle-of-attack control lever
17. Handle.
18. Size adjustment tube.
19. Fastening bolts.
20. Nuts.
21. Attachment device.

DESCRIPTION OF THE PREFERRED MODE OF EMBODIMENT

The present invention is an individual device for water propulsion of the type which includes two pedals (5) moving a fin (10) and a main body (1) attached to a bar (12) connecting the device to the hip of the swimmer.

The individual device for water propulsion is flat and plate-shaped and elongated with defined curves seen from the side, forming a main body (1). At one end of this plate, it contains two side plates (2) which are connected in a sliding way to each side of the main body (1) by means of two rails (3) which slide longitudinally and are connected bilaterally to the main body (1). Two pedals (5) are attached to these plates and are held by brackets (4) that support them to the side plates (2) in a perpendicular way. In the middle of the plate there is a hinge (7) or flexible material that attaches one end of the main body (1) with a fin (10) in a pivoting way. In a preferred embodiment this fin (10) can be of the vertical tail type, that is to say that it is pivoting from side to side by means of an axis that is arranged in a vertical way when the user uses the device in face down position.

At the hinge, the main body (1) has a widening (14) that stabilizes the device vertically to counteract the lateral effect of the fin (10). Then the body narrows to reduce the resistance of the water by a certain length and then widens again to end up in the fin (10), elongated and flexible which acts as a propeller fin.

At the height of the narrow part of the fin (10), on each side there is at least one horizontal stabilizing fin (11) that serves as a horizontal stabilizer to maintain the horizontal level and prevent the device's tail from sinking.

At the head of the side opposite the tail fin, a bar is installed that attaches the main body to a semi-arch (12) that holds the swimmer to its hip, giving the feeling that the device is an extension of its body.

At the end of the bar that holds a semi-arch (12) there is a semi-hoop (13) that holds the user by the hip. This semi-hoop is attached to one end of the bar (12). At the sides of the semi-hoop there are two variable horizontal control fins (15), which are moved by an angle-of-attack control lever (16) ending in some handles (17) to control the angle of attack thereof and can be moved independently of each other, thus allowing to ascend, dive or turns on its axis.

When the pedals (5), which are held by supports (6) for the instep of the swimmer's feet, are operated, extending and retracting them, with both feet alternately, they move two rods (8) which connect to the fin (10) by means of T-shaped supports (9) which are attached to the base of the fin (10), moving it from side to side. These two rods (8) are coupled with the T-shaped supports (9), and this gives a leverage action that multiplies the force to the action of the pedals. Thus also these two rods (8) attach the brackets (4) with the fin (10).

On the bar that holds a semi-arch (12) there is a size adjustment tube (18) to regulate the size of the swimmer (18) by adjusting the fastening bolts (19) and nuts (20).

INDUSTRY APPLICATION

The invention has application in the industry as it is a device which can be used to propel oneself in the water, whether for sports, recreational purposes, such as diving, underwater hunting, or as in-water rescue equipment for lifeguards or rescue teams at sea.

Wherever speed is required to move in the water.

The invention claimed is:

1. A device for water propulsion that includes two pedals that move a fin and a main body attached to a bar that connects the device to a respective hip of a swimmer comprising:

two rails attached bilaterally to the main body;

two side plates attached in a sliding way to each of the rails;

two brackets that attach the pedals to the side plates in a perpendicular way;

a flexible material or hinge that attaches one end of the main body to the fin in a pivoting way, said fin being flexible;

two rods that connect the brackets with the fin, wherein the rods are connected to the fin by means of T-shaped supports; and a semi-hoop attached to one end of the bar, wherein the semi-hoop has a variable horizontal control fin, which can be moved by means of angle-of-attack control levers, with handles, and wherein the main body has a widening which stabilizes the device vertically.

2. The device for water propulsion according to claim 1, wherein the fin is a vertical tail fin.

3. The device for water propulsion according to claim 1, the pedals have supports for a respective instep of the swimmer's feet.

4. The device for water propulsion according to claim 1, wherein the fin has at least one horizontal stabilizing fin on each side.

5. The device for water propulsion according to claim 1, wherein the bar has a size adjustment tube by means of adjusting fastening bolts and nuts.

* * * * *